US009005863B2

(12) United States Patent
Takagi et al.

(10) Patent No.: US 9,005,863 B2
(45) Date of Patent: Apr. 14, 2015

(54) ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

(71) Applicant: Fuji Xerox Co., Ltd., Tokyo (JP)

(72) Inventors: Shinpei Takagi, Kanagawa (JP); Soichiro Kitagawa, Kanagawa (JP); Shinya Sakamoto, Kanagawa (JP); Tomohiro Shinya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/912,865

(22) Filed: Jun. 7, 2013

(65) Prior Publication Data

US 2014/0099579 A1 Apr. 10, 2014

(30) Foreign Application Priority Data

Oct. 10, 2012 (JP) ..... 2012-225510

(51) Int. Cl.

| | |
|---|---|
| ***G03G 9/087*** | (2006.01) |
| ***G03G 9/093*** | (2006.01) |
| ***G03G 9/113*** | (2006.01) |
| ***G03G 15/06*** | (2006.01) |
| ***G03G 15/08*** | (2006.01) |

(52) U.S. Cl.

CPC ..... *G03G 9/1137* (2013.01); *G03G 15/06* (2013.01); *G03G 15/08* (2013.01); *G03G 9/09328* (2013.01); *G03G 9/09371* (2013.01); *G03G 9/09392* (2013.01)

(58) Field of Classification Search

CPC ..... G03G 9/08755; G03G 9/08797; G03G 9/08795; G03G 9/09392; G03G 9/09328; G03G 9/09321

USPC ..... 430/109.4, 110.2

See application file for complete search history.

(56) References Cited

U.S. PATENT DOCUMENTS

| | | | | |
|---|---|---|---|---|
| 2007/0048647 | A1* | 3/2007 | Daimon et al. | 430/110.2 |
| 2010/0055592 | A1 | 3/2010 | Zhou et al. | |
| 2010/0055593 | A1* | 3/2010 | Zhou et al. | 430/108.4 |
| 2012/0021349 | A1 | 1/2012 | Tani et al. | |
| 2012/0107737 | A1 | 5/2012 | Zhou et al. | |

FOREIGN PATENT DOCUMENTS

| | | |
|---|---|---|
| JP | A-2007-147927 | 6/2007 |
| JP | A-2010-55092 | 3/2010 |
| JP | A-2010-60651 | 3/2010 |
| JP | A-2012-42941 | 3/2012 |

* cited by examiner

*Primary Examiner* — Hoa V Le
(74) *Attorney, Agent, or Firm* — Oliff PLC

(57) ABSTRACT

An electrostatic charge image developing toner includes toner particles having a core that includes a block copolymer of a crystalline polyester block and an amorphous polyester block, and a shell that covers the core and includes an amorphous polyester resin having an ethylenically unsaturated double bond, and of which a surface layer part includes a crosslinked product of the amorphous polyester resin having an ethylenically unsaturated double bond.

15 Claims, 2 Drawing Sheets

ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2012-225510 filed Oct. 10, 2012.

BACKGROUND

Technical Field

The present invention relates to an electrostatic charge image developing toner, an electrostatic charge image developer, a toner cartridge, a process cartridge, an image forming apparatus, and an image forming method.

SUMMARY

According to an aspect of the invention, there is provided an electrostatic charge image developing toner including toner particles having a core that includes a block copolymer of a crystalline polyester block and an amorphous polyester block, and a shell that covers the core and includes an amorphous polyester resin having an ethylenically unsaturated double bond, and of which a surface layer part includes a crosslinked product of the amorphous polyester resin having an ethylenically unsaturated double bond.

BRIEF DESCRIPTION OF THE DRAWINGS

Exemplary embodiments of the present invention will be described in detail based on the following figures, wherein.

DETAILED DESCRIPTION

Figure 1:
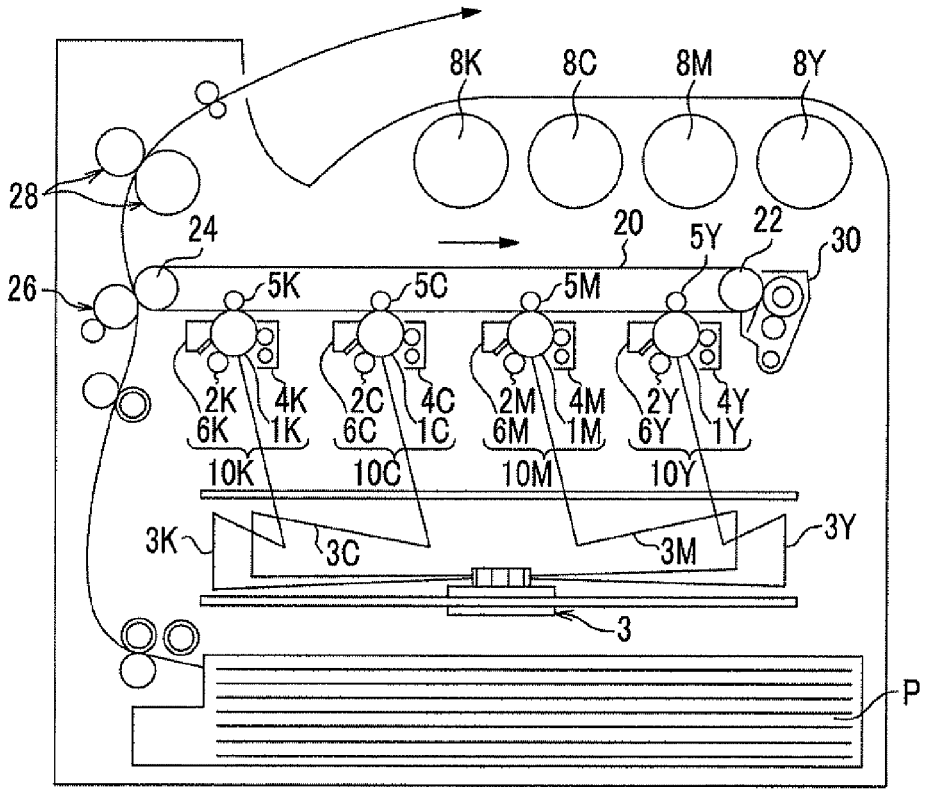
FIG. 1 is a schematic diagram showing a configuration of an example of an image forming apparatus according to an exemplary embodiment.

Hereinafter, an exemplary embodiment of the invention will be described in detail.

Electrostatic Charge Image Developing Toner

An electrostatic charge image developing toner (hereinafter, also referred to as "toner") according to an exemplary embodiment contains toner particles having: a core that includes a block copolymer of a crystalline polyester resin and an amorphous polyester resin; and a shell that covers the core and includes an amorphous polyester resin having an ethylenically unsaturated double bond, and of which the surface layer part includes a crosslinked product of the amorphous polyester resin having an ethylenically unsaturated double bond.

The toner of this exemplary embodiment is a toner that maintains low-temperature fixability and suppresses image unevenness. The reason for this is not clear, but is presumed as follows.

Hitherto, using, as a binder resin, a resin formed of a block copolymer of an amorphous polyester resin and a crystalline polyester resin has been proposed.

However, while the compressive strength of toner particles is realized, the crystalline polyester resin component is exposed to the surface of the toner particles, and thus there is a tendency that the surface strength of the toner particles is reduced. When the surface strength of the toner particles is reduced, embed of an external additive easily occurs, and thus there is a tendency that toner transferability in the transfer process is reduced and image quality unevenness occurs.

On the other hand, it is thought that the toner according to this exemplary embodiment has low-temperature fixability by using, as a binder resin, a crystalline polyester resin in combination in the core of the toner particles of the toner.

Here, the core of the toner particles is configured to include a block copolymer of a crystalline polyester resin and an amorphous polyester resin, that is a binder resin, and compatibility between the crystalline polyester resin and the amorphous polyester resin, that are difficult to mix with each other, is improved by chemically bonding the resins. Accordingly, there is a tendency that the toner particles have the crystalline polyester resin in the copolymer in a small domain state in which the crystalline polyester resin is dispersed in the entire core of the toner particles, as compared with toner particles including a simple mixture of the above resins.

As a result, it is presumed that the low-temperature fixability (sharp melt property) of the crystalline polyester resin is obtained over the entire toner particles and the low-temperature fixability is thus realized. It is thought that appropriate elasticity is easily maintained also in a fixing temperature area after sharp melting.

Meanwhile, the shell that covers the core has a two-layer configuration of a layer including an amorphous polyester resin having an ethylenically unsaturated double bond and a surface layer part including a crosslinked product of an amorphous polyester resin having an ethylenically unsaturated double bond. Accordingly, it is thought that the crystalline polyester resin having a low melting temperature is suppressed from being exposed to the surface of the toner particles from the core of the toner particles, as compared with the amorphous polyester resin.

In addition, since the surface layer part of the toner particles is configured of a crosslinked product of an amorphous polyester resin having an ethylenically unsaturated double bond, it is thought that the mechanical strength of the surface of the toner particles is improved and an external additive is suppressed from being embedded in the toner particles, whereby a reduction in transferability of the toner particles is suppressed.

In the toner according to this exemplary embodiment, since the crosslinked product constituting the surface layer part of the toner particles is a crosslinked product of an amorphous polyester resin having an ethylenically unsaturated double bond exposed to the surface of the toner particles, it is thought that a thin coating layer is formed as compared with coating layers configured by a polymer by traditional radical polymerization, graft polymerization, and seed polymerization of vinyl monomers.

Therefore, heat that is supplied from a fixing member is given to all of the toner particles, and thus melted parts of the binder resin of the toner particles are easily evenly distributed and there is a tendency that the coating layer is easily broken by a pressure at the time of fixing.

As a result, in the case of the toner according to this exemplary embodiment, permeation of the binder resin (particularly, crystalline polyester resin) included in the toner particles during fixing is promoted not only by the temperature but also by the pressure, and thus it is thought that low-temperature fixability is realized.

From the above description, it is presumed that the toner of this exemplary embodiment maintains low-temperature fixability and suppresses image unevenness.

Regarding the toner according to this exemplary embodiment, since the crystalline polyester resin is suppressed from being exposed to the surface of the toner particles, there is a tendency that a phenomenon in which the toner particles adhere to each other (hereinafter, referred to as "heat-resistant blocking property") is difficult to occur and the toner becomes excellent in powder fluidity.

Hereinafter, a configuration of the toner according to this exemplary embodiment will be described in detail.

The toner according to this exemplary embodiment has toner particles, and if necessary, an external additive.

First, the toner particles will be described.

The toner particles have a core-shell structure including a core (core particle) and a shell (shell layer) that covers the core.

The core of the toner particles will be described.

The core of the toner particles is configured to include a block copolymer of a crystalline polyester resin and an amorphous polyester resin, that is a binder resin, and if necessary, other binder resins, a colorant, a release agent, and other additives.

The binder resin will be described.

As the binder resin, at least a block copolymer of a crystalline polyester resin and an amorphous polyester resin is applied. The binder resin may be used in combination with other binder resins. When the binder resin is used in combination with other binder resins, an amorphous polyester resin, or an amorphous polyester resin and a crystalline polyester resin are preferably used.

Here, "crystalline" means that the resin has a definite heat absorption peak, but not a stepwise endothermic change in differential scanning calorimetry (DSC). Specifically, it means that the half-value width of the heat absorption peak in the measurement at a rate of temperature increase of 10° C./min is at most 15° C. On the other hand, "amorphous" means that the resin has a heat absorption peak having a half-value width exceeding 15° C., or exhibits only a stepwise endothermic change, but not a definite heat absorption peak.

The block copolymer will be described.

The block copolymer of a crystalline polyester resin and an amorphous polyester resin (hereinafter, referred to as "polyester block copolymer") is a polyester block copolymer having a crystalline polyester resin block (hereinafter, referred to as "crystalline polyester block") and an amorphous polyester resin block (hereinafter, referred to as "amorphous polyester block"). The block copolymer may have other blocks other than the crystalline polyester block and the amorphous polyester block.

Examples of the method of manufacturing the polyester block copolymer include a manufacturing method including obtaining a polyester block copolymer through a polymerization reaction by mixing a crystalline polyester resin and an amorphous polyester resin, a manufacturing method including performing polymerization by mixing a monomer that forms an amorphous polyester resin with a crystalline polyester resin, and a manufacturing method including performing polymerization by mixing a monomer that forms a crystalline polyester resin with an amorphous polyester resin. Among them, a method of obtaining a polyester block copolymer through a polymerization reaction by mixing a crystalline polyester resin and an amorphous polyester resin is preferable.

The crystalline polyester block and the amorphous polyester block are easily prepared by, for example, performing polycondensation through a direct esterification reaction in an aqueous solvent, a transesterification reaction, or the like by combining the following condensation polymerizable monomers.

Examples of the crystalline polyester block include a condensation polymer of a polyvalent carboxylic acid and a polyol and a ring-opened polymer of cyclic monomers.

Examples of the polyvalent carboxylic acid that is used to obtain the crystalline polyester block include oxalic acid, malonic acid, succinic acid, glutaric acid, adipic acid, pimelic acid, suberic acid, azelaic acid, sebacic acid, maleic acid, fumaric acid, citraconic acid, itaconic acid, glutaconic acid, n-dodecylsuccinic acid, n-dodecenylsuccinic acid, isododecylsuccinic acid, isododecenylsuccinic acid, n-octylsuccinic acid, n-octenylsuccinic acid, and acid anhydrides and acid chlorides thereof.

Examples of the polyol that is used to obtain the crystalline polyester block include ethylene glycol, diethylene glycol, triethylene glycol, 1,2-propylene glycol, 1,3-propylene glycol, 1,4-butanediol, 1,4-butenediol, neopentyl glycol, 1,5-pentane glycol, 1,6-hexane glycol, 1,4-cyclohexanediol, 1,4-cyclohexanedimethanol, dipropylene glycol, polyethylene glycol, and polypropylene glycol.

Examples of the cyclic monomer include caprolactone.

Specific examples of the crystalline polyester block include a condensation polymer of ethylene glycol and glutaric acid, a condensation polymer of 1,9-nonanediol and 1,10-decanedicarboxylic acid, a condensation polymer of cyclohexanediol and adipic acid, a condensation polymer of ethylene glycol, propanediol, or 1,6-hexanediol and sebacic acid, and a condensation polymer of ethylene glycol, propanediol, or butanediol and succinic acid. Among them, a condensation polymer of 1,10-decanedicarboxylic acid and 1,6-hexanediol, a condensation polymer of 1,10-decanedicarboxylic acid and 1,9-nonanediol, and a condensation polymer of sebacic acid and 1,6-hexanediol are preferable.

Examples of the amorphous polyester block include a condensation polymer of a polyvalent carboxylic acid and a polyol and a condensation polymer of hydroxy carboxylic acids.

The polyvalent carboxylic acid that is used to obtain the amorphous polyester block is a compound containing two or more carboxylic groups in one molecule. Examples of the polyvalent carboxylic acid that is used to obtain the amorphous polyester block include dicarboxylic acids (divalent carboxylic acids) containing two carboxylic groups in one molecule and polyvalent carboxylic acids other than dicarboxylic acids, containing three or more carboxylic groups in one molecule.

Examples of the dicarboxylic acids include phthalic acid, isophthalic acid, terephthalic acid (TPA), tetrachlorophthalic acid, chlorophthalic acid, nitrophthalic acid, p-carboxyphenylacetic acid, p-phenylene diacetic acid, m-phenylene diglycolic acid, p-phenylene diglycolic acid, o-phenylene diglycolic acid, diphenyldiacetic acid, diphenyl-p,p'-dicarboxylic acid, naphthalene-1,4-dicarboxylic acid, napthalene-1,5-dicarboxylic acid, naphthalene-2,6-dicarboxylic acid, anthracenedicarboxylic acid, cyclohexanedicarboxylic acid, and n-dodecylsuccinic acid (DSA).

Examples of the polyvalent carboxylic acids other than dicarboxylic acids include trimellitic acid, pyromellitic acid, naphthalenetricarboxylic acid, naphthalenetetracarboxylic acid, pyrenetricarboxylic acid, and pyrenetetracarboxylic acid.

In addition, acids in which the carboxy group of the above carboxylic acids is changed to an acid anhydride, acid chloride, ester, or the like may be used.

Among them, terephthalic acid and lower esters thereof, diphenyldiacetic acid, and cyclohexanedicarboxylic acid are preferable. Lower esters are esters of aliphatic alcohols having from 1 to 8 carbon atoms.

The polyol that is used to obtain the amorphous polyester block is a compound containing two or more hydroxyl groups in one molecule. Examples of the polyol that is used to obtain the amorphous polyester block include diols (divalent alcohols) containing two hydroxyl groups in one molecule and polyols containing three or more hydroxyl groups in one molecule.

Examples of the diols include ethylene glycol, diethylene glycol, triethylene glycol, polyethylene glycol, propylene glycol, dipropylene glycol, polypropylene glycol, butanediol, butenediol, pentane glycol, hexanediol, cyclohexanediol, cyclohexanedimethanol, octanediol, decanediol, dodecanediol, neopentyl glycol, polytetramethylene glycol, bisphenol-A, bisphenol-Z, and hydrogenated bisphenol-A. Among them, in the case of bisphenols such as bisphenol-A, bisphenol-Z, and hydrogenated bisphenol-A, from 1 mol to 6 mol of an alkylene oxide such as an ethylene oxide and a propylene oxide may be added thereto per molecule, and among them, an ethylene oxide 2-mol adduct and an ethylene oxide 3-mol adduct are preferable.

Examples of the polyols other than dials include glycerin, pentaerythritol, hexamethylolmelamine, hexaethylolmelamine, tetramethylolbenzoguanamine, and tetraethylolbenzoguanamine.

Since these polyols are poorly soluble or insoluble in an aqueous solvent, an ester synthesis reaction proceeds in monomer droplets in which a polyol is dispersed in an aqueous solvent.

Among them, polytetramethylene glycol, bisphenol-A, bisphenol-Z, hydrogenated bisphenol-A, and cyclohexanedimethanol are preferable.

Examples of the amorphous polyester block include a condensation product of terephthalic acid (TPA) and an ethylene oxide adduct of bisphenol-A, a condensation product of terephthalic acid (TPA) and a propylene oxide-and-ethylene oxide adduct of bisphenol A, and a condensation product of n-dodecylsuccinic acid, terephthalic acid, and a propylene oxide adduct of bisphenol-A. Among them, a condensation product of n-dodecylsuccinic acid, terephthalic acid, and a propylene oxide adduct of bisphenol-A is preferable.

Here, in order to generate the crystalline polyester block or the amorphous polyester block, the respective polyvalent carboxylic acids and the polyols may be used singly or in a combination of two or more types. Otherwise, one type of polyvalent carboxylic acid (or polyol) and two or more types of polyols (or polyvalent carboxylic acids) may be used.

In addition, when hydroxy carboxylic acids are used, these may be used singly or in a combination of two or more types. A polyvalent carboxylic acid or a polyol may be used in combination.

Regarding the content of the polyester block copolymer in the binder resin of the core, the crystalline polyester block and the amorphous polyester block are preferably from 5.0% by weight to 100% by weight, and more preferably from 30% by weight to 100% by weight. When the content is less than 5.0% by weight, excellent low-temperature fixability may not be maintained.

The weight average molecular weight (Mw) of the polyester block copolymer is, for example, preferably from 15000 to 70000, more preferably from 20000 to 60000, and even more preferably from 30000 to 50000.

The weight average molecular weight is measured by gel permeation chromatography (GPC). The molecular weight measurement by GPC is performed with a THF solvent using GPC•HLC-8120, manufactured by Tosoh Corporation, as a measuring device and a column TSKgel Super HM-M (15 cm), manufactured by Tosoh Corporation. The weight average molecular weight and the number average molecular weight are calculated using a molecular weight calibration curve that is plotted using a monodisperse polystyrene standard sample from the result of the above measurement. Hereinafter, the measurement is performed in the same manner.

The polyester block copolymer preferably has a crystalline polyester block having a glass transition temperature (Tg) of 0° C. or lower and an amorphous polyester block having a Tg of 50° C. or higher. The polyester block copolymer may have other crystalline or amorphous polyester blocks, other than the crystalline polyester block having a Tg of 0° C. or lower and the amorphous polyester block having a Tg of 50° C. or higher. However, the polyester block copolymer is preferably a polyester block copolymer including at least one type of crystalline polyester block having a Tg of 0° C. or lower and at least one type of amorphous polyester block having a Tg of 50° C. or higher, more preferably a diblock copolymer formed only of one type of crystalline polyester block having a Tg of 0° C. or lower and one type of amorphous polyester block having a Tg of 50° C. or higher, and even more preferably a diblock copolymer formed only of one crystalline polyester block having a Tg of 0° C. or lower and one amorphous polyester block having a Tg of 50° C. or higher.

The weight ratio of the crystalline polyester block to the amorphous polyester block in the polyester block copolymer is preferably from 1/20 to 20/1, more preferably from 1/10 to 10/1, and even more preferably from 1/9 to 5/5 (crystalline polyester block/amorphous polyester block). When the weight ratio is in the above range, there is a tendency that the mechanical strength of the polyester block copolymer increases in the manufacturing of the toner, and thus excellent low-temperature fixability is obtained.

When a polyester block copolymer is obtained through a polymerization reaction by mixing a crystalline polyester block and an amorphous polyester block, the melting temperature of the crystalline polyester block is preferably from 40° C. to 150° C., more preferably from 50° C. to 120° C., and even more preferably from 50° C. to 90° C. When the melting temperature of the crystalline polyester block is in the above range, there is a tendency that the obtained toner has an excellent heat-resistant blocking property and is excellent in melt fluidity and fixability even at low temperature.

Other binder resins will be described.

Other crystalline resins (crystalline vinyl resins) and other amorphous resins (for example, known amorphous resins such as styrene/acryl resins, epoxy resins, polyester resins, polyurethane resins, polyamide resins, cellulose resins, polyether resins, and polyolefin resins) are exemplified as other binder resins.

These other binder resins are blended in such a range as not to affect the characteristics of the toner.

The colorant will be described.

The colorant is not particularly limited as long as it is a known colorant. Examples thereof include carbon blacks such as furnace black, channel black, acetylene black, and thermal black, inorganic pigments such as red iron oxide, iron blue, and titanium oxide, azo pigments such as fast yellow, disazo yellow, pyrazolone red, chelate red, brilliant carmine, and para brown, phthalocyanine pigments such as copper phthalocyanine and metal-free phthalocyanine, and condensed polycyclic pigments such as flavanthrone yellow, dibromoanthrone orange, perylene red, quinacridone red, and dioxazine violet.

If necessary, the colorant may be surface-treated, or may be used in combination with a dispersant. Plural types of colorants may be used in combination.

The content of the colorant is preferably from 1 part by weight to 30 parts by weight with respect to 100 parts by weight of the binder resin.

The release agent will be described.

Examples of the release agent include, but are not limited to, hydrocarbon waxes; natural waxes such as carnauba wax, rice wax, and candelilla wax; synthetic, or mineral or petroleum waxes such as montan wax; and ester waxes such as fatty acid esters and montanate esters.

The melting temperature of the release agent is preferably 50° C. or higher, and more preferably 60° C. or higher from the viewpoint of preservability. In addition, the melting temperature is preferably 110° C. or lower, and more preferably 100° C. or lower from the viewpoint of an offset-resistant property.

The content of the release agent is, for example, preferably from 2 parts by weight to 30 parts by weight with respect to 100 parts by weight of the binder resin.

Other additives will be described.

Magnetic materials, a charge control agent, inorganic powders, and the like are exemplified as other additives.

The shell of the toner particles will be described.

The shell of the toner particles is a layer that covers a core and includes an amorphous polyester resin having an ethylenically unsaturated double bond. In addition, a surface layer part thereof is configured to include a crosslinked product of an amorphous polyester resin having an ethylenically unsaturated double bond.

The shell is preferably from 5% by weight to 40% by weight, more preferably from 10% by weight to 35% by weight, and even more preferably from 10% by weight to 30% by weight with respect to the toner particles. When the shell is in the above range with respect to the toner particles, the strength of the shell increases in the crosslinking of the surface layer part, the powder fluidity by embed of an external additive and the like is easily improved. In addition, the low-temperature fixability of the core of the toner particles is improved and a fixability improvement function is easily exhibited.

The amorphous polyester resin having an ethylenically unsaturated double bond will be described.

Examples of the amorphous polyester resin having an ethylenically unsaturated double bond include a condensation polymer of monomers that is a condensation polymer of a polyvalent carboxylic acid and a polyol with a functional group having an ethylenically unsaturated double bond (for example, a crosslinkable functional group such as a vinyl group, a vinylene group, and a c=c bond) in at least one of the polyvalent carboxylic acid and the polyol.

The amorphous polyester resin having an ethylenically unsaturated double bond is preferably a condensation polymer of a polyvalent carboxylic acid and a polyol with a functional group having an ethylenically unsaturated double bond, and more preferably a condensation polymer of a dicarboxylic acid and a diol with a functional group having an ethylenically unsaturated double bond, that is, a linear polyester resin, from the viewpoint of, for example, stability.

Examples of the dicarboxylic acid having an ethylenically unsaturated double bond include fumaric acid, maleic acid, maleic anhydride, citraconic acid, mesaconic acid, itaconic acid, glutaconic acid, allyl malonic acid, isopropylidene succinic acid, acetylenedicarboxylic acid, and lower (from 1 to 4 carbon atoms) alkyl esters thereof.

Examples of the polyvalent carboxylic acid other than the dicarboxylic acid having an ethylenically unsaturated double bond include aconitic acid, 3-butene-1,2,3-tricarboxylic acid, 4-pentene-1,2,4-tricarboxylic acid, 1-pentene-1,1,4,4-tetracarboxylic acid, and lower (from 1 to 4 carbon atoms) alkyl ester thereof.

These polyvalent carboxylic acids may be used singly or in a combination of two or more types.

Examples of the diol include bisphenol-A, hydrogenated bisphenol-A, ethylene oxide adduct, propylene oxide adduct, and ethylene oxide-and-propylene oxide adduct of bisphenol-A, 1,4-cyclohexanediol, 1,4-cyclohexanedimethanol, ethylene glycol, diethylene glycol, propylene glycol, dipropylene glycol, 1,3-butanediol, 1,4-butanediol, 1,5-pentanediol, 1,6-hexanediol, 1,9-nonanediol, and neopentyl glycol.

Glycerin, trimethylolethane, trimethylolpropane, pentaerythritol, and the like are exemplified as tri- or higher-hydric alcohol.

If necessary, a monovalent acid such as acetic acid or benzoic acid, or a monohydric alcohol such as cyclohexanol or benzyl alcohol may be used in combination with the polyol, in order to adjust the acid value or the hydroxyl value. These polyols may be used singly or in a combination of two or more types.

Among the amorphous polyester resins having an ethylenically unsaturated double bond that are condensation polymers of a polyvalent carboxylic acid and a polyol, a condensation polymer of at least one type of dicarboxylic acid selected from fumaric acid, maleic acid, and maleic anhydride and a diol is particularly preferable. That is, the ethylenically unsaturated double bond of the amorphous polyester resin is preferably a site derived from at least one type of dicarboxylic acid selected from fumaric acid, maleic acid, and maleic anhydride. It is preferable that the amorphous polyester resin include a site derived from at least one type of dicarboxylic acid selected from fumaric acid, maleic acid, and maleic anhydride, since the amorphous polyester resin having an ethylenically unsaturated double bond is partially crosslinked and the surface layer part of the toner particles is formed.

The crosslinked product of the amorphous polyester resin having an ethylenically unsaturated double bond will be described.

In the crosslinked product of the amorphous polyester resin having an ethylenically unsaturated double bond, the ethylenically unsaturated double bond part of the amorphous polyester resin having an ethylenically unsaturated double bond is formed by bonding through a polymerization reaction with a polymerization initiator.

The crosslinked product constituting the surface layer part of the toner particles is a reaction product of the amorphous polyester resin having an ethylenically unsaturated double bond and is a resin-insoluble component (hereinafter, referred to as "THF-insoluble matter") of the toner particles, that is insoluble in tetrahydrofuran (THF). That is, the amount of the crosslinked product is equivalent to that of the THF-insoluble matter.

The resin-insoluble component of the toner particles, that is insoluble in tetrahydrofuran (THF), is, for example, preferably from 0.1% by weight to 5.0% by weight, more preferably from 0.5% by weight to 4.0% by weight, and even more preferably from 1.0% by weight to 3.0% by weight with respect to the toner particles.

When the THF-insoluble matter is in the above range, the surface layer part (crosslinked product) of the toner particles does not inhibit the melting of the binder resin of the core of the toner particles due to heat conductance at the time of fixing, and also does not inhibit permeation of the binder resin at the time of fixing because the toner particles have the mechanical strength so that the shell is broken by a pressure at the time of fixing. Accordingly, there is a tendency that the low-temperature fixability of the toner is easily maintained and a reduction in image gloss is suppressed. Since the surface layer part (crosslinked product) of the toner particles has a mechanical strength, suppresses exposure of the crystalline polyester block to the surface of the toner particles, and prevents embed of an external additive and the like, there is a tendency that image unevenness is suppressed.

Here, the THF-insoluble matter derived from the crosslinked product of the amorphous polyester resin having an ethylenically unsaturated double bond is measured as follows.

(1) From 0.5 g to 1.0 g of toner particles are directly weighed in a 100 ml conical flask, 50 ml of THF is put thereinto, and the conical flask is sealed to perform ultrasonic dispersion.

(2) A membrane filter (mesh size: 0.20 μm) is weighed.

(3) The membrane filter is attached to a suction bottle to filter the solution of (1).

(4) The membrane filter with the residues remaining thereon is put into a vacuum dryer at 80° C., left and dried for 30 minutes, and then cooled and dried in a desiccator to precisely weigh the filter.

(5) The numerical value calculated using the following calculation formula corresponds to the THF-insoluble matter in the toner.

Calculation Formula: THF-Insoluble Matter in Toner= $(B-A)\div S$

A: Weight of Membrane Filter Before Filtration

B: Weight of Membrane Filter After Filtration

S: Collected Amount of Sample

The residues on the membrane filter are analyzed by, for example, a pyrolysis gas chromatography mass spectrometer (thermal decomposition GC/MS), and from the peak area detected by the mass spectrometer, the amount of the THF-insoluble matter derived from the crosslinked product of the amorphous polyester resin having an ethylenically unsaturated double bond is calculated.

The characteristics of the toner particles will be described.

As for the toner particles, the surface layer part thereof (crosslinked product of the amorphous polyester resin having an ethylenically unsaturated double bond) preferably has a glass transition temperature (Tg) that is higher than a Tg of the interior part (part other than the surface layer part).

Accordingly, the gloss of a fixed image is improved (that is, the agglomeration of the toner particles in the toner image is suppressed) and the low-temperature fixability is also realized.

The toner particles preferably have two or more heat absorption peaks from 60° C. to 90° C. in a DSC curve measured by a differential scanning calorimeter (DSC).

That is, the toner particles are preferably configured to include a release agent together with the crystalline polyester resin, the amorphous polyester resin, and the amorphous polyester resin having an ethylenically unsaturated double bond, and the two or more heat absorption peaks correspond to heat absorption peaks derived from the crystalline polyester resin and the release agent.

Accordingly, both of the low-temperature fixability of the toner and the releasability of the toner are realized.

In the toner particles, the existence ratio of the crystalline resin (crystalline polyester) to the release agent (when it is included) in the surface of the toner particles after heating and storage for 48 hours at a temperature of 50° C. is preferably 20% or less, more preferably 10% or less, and even more preferably 5% or less in total.

Accordingly, a reduction in thermal storability or fluidity is also suppressed and a reduction in a charging property is also easily suppressed.

Here, the existence ratio is measured as follows.

A heated and stored toner is dyed with ruthenium and a dyed toner particle surface is observed by a scanning electron microscope (FE-SEM). The existence ratio in the toner particle surface is calculated by judging the crystalline resin (crystalline polyester) and the release agent from the contrast and the shape of the toner particle surface and image analysis. In the dyeing, a 0.5% aqueous ruthenium tetraoxide solution is used, and as for the recognition method, the release agent and the crystalline resin are dyed with the ruthenium, and thus the crystalline resin and the release agent are recognized.

The volume average particle size of the toner particles is, for example, preferably from 2.0 μm to 10 μm, and more preferably from 4.0 μm to 8.0 μm.

In a method of measuring the volume average particle size of the toner particles, from 0.5 mg to 50 mg of a measurement sample is added to 2 ml of a 5% by weight aqueous solution of a surfactant, preferably sodium alkylbenzene sulfonate as a dispersant, and this mixture is added to from 100 ml to 150 ml of the electrolyte. The electrolyte including the measurement sample suspended therein is subjected to a dispersion treatment by an ultrasonic disperser for about 1 minute, and a particle size distribution of particles having a particle size of from 2.0 μm to 60 μm is measured by a Coulter Multisizer II (manufactured by Beckman Coulter, Inc.) using an aperture having an aperture diameter of 100 μm. The number of the particles to be measured is 50,000.

Regarding the volume, a cumulative distribution is drawn from the small diameter side with respect to particle size ranges (channels) divided on the basis of the obtained particle size distribution. A particle size at an accumulation of 50% is defined as a volume average particle size D50v.

The external additive will be described.

Examples of the external additive include inorganic particles, and examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_1$, and $MgSO_4$.

An external additive particle surface may be subjected to a hydrophobization treatment in advance. The hydrophobization treatment is performed by, for example, dipping the inorganic particles in a hydrophobizing agent. The hydrophobizing agent is not particularly limited, and examples thereof include silane coupling agents, silicone oils, titanate coupling agents, and aluminum coupling agents. These may be used singly or in a combination of two or more types.

Generally, the amount of the hydrophobizing agent is, for example, approximately from 1 part by weight to 10 parts by weight with respect to 100 parts by weight of the inorganic particles.

The amount of the external additive to be externally added is, for example, preferably from 0.5 part by weight to 2.5 parts by weight with respect to 100 parts by weight of the toner particles.

A method of manufacturing the toner according to this exemplary embodiment will be described.

First, toner particles may be manufactured using any of a dry manufacturing method (for example, a kneading pulverization method) and a wet manufacturing method (for example, an aggregation coalescence method, a suspension polymerization method, a dissolution suspension granulation method, a dissolution suspension method, and a dissolution emulsification aggregation coalescence method). The method of manufacturing the toner is not particularly limited to these manufacturing methods, and a known manufacturing method is employed.

The ethylenically unsaturated double bond part of the amorphous polyester resin having an ethylenically unsaturated double bond that is present in the surface layer part of the obtained toner particles is crosslinked by a polymerization reaction, thereby forming a crosslinked product by the crosslinking in the surface layer part of the toner particles.

Specifically, for example, when toner particles are manufactured using the aggregation coalescence method, the toner particles are manufactured through an electrostatic charge image developing toner manufacturing method having: a process (first aggregation process) in which at least a copolymer particle dispersion in which polyester block copolymer particles (hereinafter, referred to as "copolymer particles") are dispersed is prepared, and at least the copolymer particles are aggregated to form first aggregated particles; a process (second aggregation process) in which a first aggregated particle dispersion in which the first aggregated particles are dispersed and an amorphous polyester resin particle dispersion in which amorphous polyester resin particles having an ethylenically unsaturated double bond are dispersed are mixed with each other for aggregation to adhere the amorphous polyester resin particles having an ethylenically unsaturated double bond to surfaces of the first aggregated particles, thereby forming second aggregated particles; a process (coalescence process) in which a second aggregated particle dispersion in which the second aggregated particles are dispersed is heated to coalesce the second aggregated particles, thereby forming toner particles before a crosslinking treatment; and a process (crosslinked product forming process) in which a polymerization initiator is adhered to surface layer parts of the toner particles by being added to a toner particle dispersion in which the toner particles are dispersed, to crosslink the ethylenically unsaturated double bond part of the amorphous polyester resin having an ethylenically unsaturated double bond present in the surface layer parts of the toner particles through a reaction, thereby forming a crosslinked product by the crosslinking in the surface layer parts of the toner particles.

Hereinafter, the respective processes will be described in detail.

In the following description, a method of obtaining toner particles including a colorant and a release agent will be described. However, the colorant and the release agent are used only if necessary. Other additives other than the colorant and the release agent may also be used.

First Aggregated Particle Forming Process

First, together with a copolymer particle dispersion in which copolymer particles are dispersed, for example, a colorant particle dispersion in which colorant particles are dispersed and a release agent dispersion in which release agent particles are dispersed are prepared.

The copolymer particle dispersion is prepared by, for example, dispersing copolymer particles using a surfactant in a dispersion solvent.

An aqueous solvent is exemplified as the dispersion solvent that is used for the copolymer particle dispersion.

Examples of the aqueous solvent include water such as distilled water and ion exchange water and alcohols. These may be used singly or in a combination of two or more types thereof.

The surfactant is not particularly limited, and examples thereof include anionic surfactants such as sulfate, sulfonate, phosphate, and soap anionic surfactants; cationic surfactants such as amine salt and quaternary ammonium salt cationic surfactants; and nonionic surfactants such as polyethylene glycol, alkyl phenol ethylene oxide adduct, and polyol nonionic surfactants. Among them, anionic surfactants and cationic surfactants are particularly preferable. Nonionic surfactants may be used in combination with anionic surfactants or cationic surfactants.

The surfactants may be used singly or in a combination of two or more types.

Regarding the copolymer particle dispersion, as a method of dispersing the copolymer particles in the dispersion solvent, for example, common dispersing methods using, for example, a rotary shearing homogenizer, a ball mill having media, a sand mill, and a Dyno mill are exemplified. In accordance with the type of resin particles to be used, copolymer particles may be dispersed in the copolymer particle dispersion using, for example, a phase-transfer emulsification method.

The phase-transfer emulsification method is a method of dispersing a resin in a particulate state in an aqueous solvent, including: dissolving a resin to be dispersed in a hydrophobic organic solvent in which the resin is soluble; adding a base to an organic continuous phase (O phase) to neutralize the solution; and putting an aqueous solvent (W phase) to carry out a conversion of the resin (so-called phase inversion) from W/O to O/W to thereby make a discontinuous phase.

The volume average particle size of the copolymer particles that are dispersed in the copolymer particle dispersion is, for example, from 0.01 μm to 1 μm, preferably from 0.08 μm to 0.8 μm, and more preferably from 0.1 μm to 0.6 μm.

The volume average particle size of the copolymer particles is measured using a laser diffraction-type particle size distribution measuring device (manufactured by Horiba, Ltd. LA-920). Hereinafter, the volume average particle size of the particles is measured in the same manner unless specifically noted.

The content of the copolymer particles that are contained in the copolymer particle dispersion is, for example, from 5% by weight to 50% by weight, and may be from 10% by weight to 40% by weight.

The colorant dispersion and the release agent dispersion are also prepared in the same manner as in the case of the copolymer particle dispersion. That is, the particles in the copolymer particle dispersion are the same as the colorant particles that are dispersed in the colorant dispersion and the release agent particles that are dispersed in the release agent dispersion, in terms of the volume average particle size, the dispersion solvent, the dispersing method, and the content of the particles.

Next, the colorant particle dispersion and the release agent dispersion are mixed together with the copolymer particle dispersion.

The copolymer particles, the colorant particles, and the release agent particles are heterogeneously aggregated in the mixed dispersion to form first aggregated particles (core aggregated particles) with a particle size near a desired toner particle size including the copolymer particles, the colorant particles, and the release agent particles.

Specifically, for example, an aggregating agent is added to the mixed dispersion and a pH of the mixed dispersion is adjusted to acidic (for example, the pH is from 2 to 5). If necessary, a dispersion stabilizer is added. Then, the mixed dispersion is heated to a glass transition temperature of the copolymer particles (specifically, for example, from 30° C. lower than the glass transition temperature to 10° C. lower than the vicat softening temperature of the copolymer particles) to aggregate the particles dispersed in the mixed dispersion, thereby forming the first aggregated particles.

In the first aggregated particle forming process, for example, the aggregating agent may be added at room temperature (for example, 25° C.) during stirring of the mixed dispersion using a rotary shearing-type homogenizer, the pH of the mixed dispersion may be adjusted to acidic (for example, the pH is from 2 to 5), a dispersion stabilizer may be added if necessary, and the heating may be then performed.

Examples of the aggregating agent include a surfactant having an opposite polarity of the polarity of the surfactant that is used as the dispersant to be added to the mixed dispersion, such as inorganic metal salts and di- or higher-valent metal complexes. Particularly, when a metal complex is used as the aggregating agent, the amount of the surfactant to be used is reduced and charging characteristics are improved.

If necessary, an additive may be used to form a complex or a similar bond with the metal ions of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

The amount of the chelating agent to be added is, for example, from 0.01 part by weight to 5.0 parts by weight, and may be from 0.1 part by weight to less than 3.0 parts by weight with respect to 100 parts by weight of the resin particles.

Second Aggregated Particle Forming Process

Next, a first aggregated particle dispersion in which the obtained first aggregated particles are dispersed and an amorphous polyester resin particle dispersion in which amorphous polyester resin particles having an ethylenically unsaturated double bond are dispersed are mixed with each other.

In the mixed dispersion, the amorphous polyester resin particles having an ethylenically unsaturated double bond are aggregated so as to be adhered to surfaces of the first aggregated particles, thereby forming second aggregated particles in which the amorphous polyester resin particles having an ethylenically unsaturated double bond are adhered to the surfaces of the first aggregated particles.

Specifically, for example, in the first aggregated particle forming process, when the particle size of the first aggregated particles reaches a target particle size (for example, the volume average particle size is 1.5 μm or greater, and preferably from 2.5 μm to 6.5 μm), the first aggregated particle dispersion is mixed with the dispersion of the amorphous polyester resin particles having an ethylenically unsaturated double bond, and this mixed dispersion is heated to a temperature that is equal to or lower than a lower one of the glass transition temperatures of the first aggregated particles and the amorphous polyester resin particles having an ethylenically unsaturated double bond.

The aggregation is terminated by adjusting a pH of the mixed dispersion to, for example, approximately from 6.5 to 8.5.

Here, the volume average particle size of the amorphous polyester resin particles having an ethylenically unsaturated double bond that are dispersed in the dispersion of the amorphous polyester resin particles having an ethylenically unsaturated double bond is, for example, from 0.01 μm to 1 μm, preferably from 0.05 μm to 0.8 μm, more preferably from 0.1 μm to 0.6 μm, and particularly preferably less than 0.3 μm (300 nm).

Accordingly, the second aggregated particles are obtained in which the amorphous polyester resin particles having an ethylenically unsaturated double bond are aggregated so as to be adhered to the surfaces of the first aggregated particles.

Coalescence Process

Next, a second aggregated particle dispersion containing the second aggregated particles dispersed therein is heated to, for example, a temperature that is higher than the glass transition temperature of the amorphous polyester resin having an ethylenically unsaturated double bond (for example, a temperature that is higher than the glass transition temperature of the amorphous polyester resin having an ethylenically unsaturated double bond by from 10° C. to 30° C.) to coalesce the second aggregated particles, thereby forming toner particles before a crosslinking treatment.

Crosslinked Product Forming Process

A polymerization initiator is added to a toner particle dispersion in which the toner particles before a crosslinking treatment are dispersed, to adhere the polymerization initiator to surface layer parts of the toner particles, thereby crosslinking the ethylenically unsaturated double bond part of the amorphous polyester resin having an ethylenically unsaturated double bond present in the surface layer parts of the toner particles through a polymerization reaction. Whereby a crosslinked product by the crosslinking is formed in the surface layer parts of the toner particles. That is, a crosslinked product of the amorphous polyester resin having an ethylenically unsaturated double bond present in the surface layer parts of the toner particles is formed by performing radical polymerization on the toner particles with the polymerization initiator.

The crosslinked product forming process is preferably carried out in the process after the coalescence process. The reasons for this are that, first, when the shell and the core are coalesced, the crosslinking treatment of the entire surface of the toner particles is easily performed, and when the crosslinking treatment is performed before the coalescence, the formed crosslinked product is prevented from inhibiting the coalescence of the shell and the core by heat.

In the formation of the crosslinked product, the reaction temperature is, for example, preferably from 50° C. to 100° C., and more preferably from 60° C. to 90° C. In the formation of the crosslinked product, the reaction time is, for example, preferably from 30 minutes to 7 hours, and more preferably from 2 hours to 5 hours.

Examples of the polymerization initiator include water-soluble polymerization initiators and oil-soluble polymerization initiators.

Examples of the water-soluble polymerization initiators include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium peroxodisulfate (APS), sodium persulfate, potassium persulfate (KPS), diisopropyl peroxycarbonate, tetralin hydroperoxide, 1-phenyl-2-methylpropyl-1-hydroperoxide, tert-butyl triphenylperacetate hydroperoxide, tert-butyl performate, tert-butyl peracetate, tert-butyl perbenzoate, tert-butyl phenylperacetate, tert-butyl methoxyperaceate, tert-butyl N-(3-toluoyl)percarbamate, ammonium bisulfate, and sodium bisulfate. These polymerization initiators may be used singly or in a combination of two or more types.

Examples of the oil-soluble polymerization initiators include azo polymerization initiators such as 2,2'-azobisisobutyronitrile, 2,2'-azobis(2,4-dimethylvaleronitrile), 1,1'-azobis(cyclohexane-1-carbonitrile), and 2,2'-azobis-4-methoxy-2,4-dimethylvaleronitrile.

These polymerization initiators are preferably dissolved in a solvent (preferably, water) for the toner particle dispersion before crosslinking.

In addition, when a water-soluble polymerization initiator is used, the amorphous polyester resin having an ethylenically unsaturated double bond only in the outermost layer of the shell of the toner particles is easily crosslinked, and thus both of the low-temperature fixability and the mechanical strength of the toner particles are easily realized.

Through the above processes, toner particles (toner particles having a core-shell structure) are obtained, that are configured by a core that includes a copolymer, and a shell that covers the core and includes an amorphous polyester resin having an ethylenically unsaturated double bond, and of which the surface layer part has a crosslinked product of the resin.

After the coalescence process, the toner particles formed in the solution are subjected to a washing process, a solid-liquid separation process, and a drying process, that are well known, and thus dry toner particles are obtained.

In the washing process, displacement washing with ion exchange water is preferably sufficiently performed in consideration of charging property. In addition, the solid-liquid separation process is not particularly limited, but suction filtration, pressure filtration, or the like is preferably used in consideration of productivity. Furthermore, the drying process is also not particularly limited, but freeze drying, flash jet drying, fluidized drying, vibration-type fluidized drying, or the like is preferably used in consideration of productivity.

The toner according to this exemplary embodiment is manufactured by, for example, adding an external additive to the obtained dry toner particles and mixing them. The mixing may be performed with, for example, a V-blender, a Henschel mixer, a Loedige mixer, or the like. Furthermore, if necessary, coarse toner particles may be removed using a vibrating sieving machine, a wind classifier, or the like.

Electrostatic Charge Image Developer

An electrostatic charge image developer according to this exemplary embodiment includes at least the toner according to this exemplary embodiment.

The electrostatic charge image developer according to this exemplary embodiment may be a single-component developer including only the toner according to this exemplary embodiment, or a two-component developer obtained by mixing the toner with a carrier.

The carrier is not particularly limited, and known carriers are exemplified. Examples of the carrier include resin-coated carriers, magnetic dispersion-type carriers, and resin dispersion-type carriers.

The mixing ratio (weight ratio) between the toner according to this exemplary embodiment and the carrier in the two-component developer is preferably from approximately 1:100 to 30:100 (toner:carrier), and more preferably from approximately 3:100 to 20:100.

Image Forming Apparatus and Image Forming Method

Next, an image forming apparatus and an image forming method according to this exemplary embodiment will be described.

The image forming apparatus according to this exemplary embodiment has an image holding member, a charging unit that charges the image holding member, an electrostatic charge image forming unit that forms an electrostatic charge image on a surface of the charged image holding member, a developing unit that accommodates an electrostatic charge image developer and develops the electrostatic charge image formed on the image holding member with the electrostatic charge image developer to form a toner image, a transfer unit that transfers the toner image formed on the image holding member onto a transfer member, and a fixing unit that fixes the toner image transferred onto the transfer member. As the electrostatic charge image developer, the electrostatic charge image developer according to this exemplary embodiment is applied.

In the image forming apparatus according to this exemplary embodiment, for example, a part including the developing unit may have a cartridge structure (process cartridge) that is detachably mounted on an image forming apparatus. As the process cartridge, for example, a process cartridge that accommodates the electrostatic charge image developer according to this exemplary embodiment and is provided with a developing unit is preferably used.

The image forming method according to this exemplary embodiment has a charging process of charging an image holding member, an electrostatic charge image forming process of forming an electrostatic charge image on a surface of the charged image holding member, a developing process of developing the electrostatic charge image formed on the image holding member with an electrostatic charge image developer to form a toner image, a transfer process of transferring the toner image formed on the image holding member onto a transfer member, and a fixing process of fixing the toner image transferred onto the transfer member. As the electrostatic charge image developer, the electrostatic charge image developer according to this exemplary embodiment is applied.

Hereinafter, an example of the image forming apparatus according to this exemplary embodiment will be shown, but the apparatus is not limited thereto. The major parts shown in the drawings will be described, but the descriptions of the other components will be omitted.

FIG. 1 is a schematic diagram showing a configuration of a four-drum tandem color image forming apparatus. The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachably mounted on an image forming apparatus body.

An intermediate transfer belt 20 as an intermediate transfer member is installed above the units 10Y, 10M, 10C, and 10K in the drawing to extend through the units. The intermediate transfer belt 20 is wound on a driving roller 22 and a support roller 24 contacting the inner surface of the intermediate transfer belt 20, which are separated from each other on the left and right sides in the drawing, and travels in a direction toward the fourth unit 10K from the first unit 10Y. The support roller 24 is pressed in a direction in which it departs from the driving roller 22 by a spring or the like (not shown), and a tension is given to the intermediate transfer belt 20 wound on both of the rollers. In addition, an intermediate transfer member cleaning device 30 opposed to the driving roller 22 is provided on a surface of the intermediate transfer belt 20 on the image holding member side.

Developing devices (developing units) 4Y, 4M, 4C, and 4K of the units 10Y, 10M, 10C, and 10K are supplied with four color toners, that is, a yellow toner, a magenta toner, a cyan toner, and a black toner accommodated in toner cartridges 8Y, 8M, 8C, and 8K, respectively.

The above-described first to fourth units 10Y, 10M, 10C, and 10K have the same configuration. Here, only the first unit 10Y that is disposed on the upstream side in a traveling direction of the intermediate transfer belt to form a yellow image will be representatively described. The same parts as in the first unit 10Y will be denoted by the reference numerals with magenta (M), cyan (C), and black (K) added instead of yellow (Y), and the descriptions of the second to fourth units 10M, 10C, and 10K will be omitted.

The first unit 10Y has a photoreceptor 1Y acting as an image holding member. Around the photoreceptor 1Y, a charging roller 2Y that charges a surface of the photoreceptor 1Y to a predetermined potential, an exposure device (electrostatic charge image forming unit) 3 that exposes the charged surface with laser beams 3Y based on a color-separated image signal to form an electrostatic charge image, a developing device (developing unit) 4Y that supplies a charged toner to the electrostatic charge image to develop the electrostatic charge image, a primary transfer roller (primary transfer unit) 5Y that transfers the developed toner image onto the intermediate transfer belt 20, and a photoreceptor cleaning device (cleaning unit) 6Y that removes the toner remaining on the surface of the photoreceptor 1Y after primary transfer, are arranged in sequence.

The primary transfer roller 5Y is disposed inside the intermediate transfer belt 20 to be provided at a position opposed to the photoreceptor 1Y. Furthermore, bias supplies (not shown) that apply a primary transfer bias are connected to the primary transfer rollers 5Y, 5M, 5C, and 5K, respectively. The bias supplies change the transfer bias that is applied to each primary transfer roller under the control of a controller (not shown).

Hereinafter, an operation of forming a yellow image in the first unit 10Y will be described. First, before the operation, the surface of the photoreceptor 1Y is charged to a potential of approximately from −600 V to −800 V by the charging roller 2Y.

The photoreceptor 1Y is formed by laminating a photosensitive layer on a conductive substrate (volume resistivity at 20° C.: $1\times10^{-6}$ Ωcm or less). This photosensitive layer typically has high resistance (that is about the same as the resistance of a general resin), but has a property in which when laser beams 3Y are applied, the specific resistance of apart irradiated with the laser beams changes. Accordingly, the laser beams 3Y are output to the surface of the charged photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow print pattern is formed on the surface of the photoreceptor 1Y.

The electrostatic charge image is an image that is formed on the surface of the photoreceptor 1Y by charging, and is a so-called negative latent image, that is formed by applying the laser beams 3Y to the photosensitive layer so that the specific resistance of the irradiated part is lowered to cause charges to flow on the surface of the photoreceptor 1Y, while charges stay on a part to which the laser beams 3Y are not applied.

The electrostatic charge image that is formed on the photoreceptor 1Y in this manner is rotated up to a predetermined development position with the travelling of the photoreceptor 1Y. The electrostatic charge image on the photoreceptor 1Y is formed as a visual image (developed image) at the development position by the developing device 4Y.

The developing device 4Y accommodates, for example, an electrostatic charge image developer according to this exemplary embodiment including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (developer holding member). By allowing the surface of the photoreceptor 1Y to pass through the developing device 4Y, the yellow toner is electrostatically adhered to a latent image part having no charge on the surface of the photoreceptor 1Y, whereby the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roller 5Y and an electrostatic force toward the primary transfer roller 5Y from the photoreceptor 1Y acts on the toner image, whereby the toner image on the photoreceptor 1Y is transferred onto the intermediate transfer belt 20. The transfer bias applied at this time has the opposite polarity (+) of the toner polarity (−), and is controlled to approximately +10 μA, for example, in the first unit 10Y by the controller (not shown).

On the other hand, the toner remaining on the photoreceptor 1Y is removed and collected by the cleaning device 6Y.

The primary transfer biases that are applied to the primary transfer rollers 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part which is configured by the intermediate transfer belt 20, the support roller 24 contacting the inner surface of the intermediate transfer belt, and a secondary transfer roller (secondary transfer unit) 26 disposed on the image holding surface side of the intermediate transfer belt 20. Meanwhile, a recording sheet (transfer member) P is supplied to a gap between the secondary transfer roller 26 and the intermediate transfer belt 20, which are pressed against each other, via a supply mechanism at a predetermined timing, and a secondary transfer bias is applied to the support roller 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (roll-shaped fixing unit) 28, and the toner image is fixed to the recording sheet P, whereby the fixed image is formed.

Examples of the transfer member onto which a toner image is transferred include plain paper that is used in electrophotographic copiers, printers, and the like and OHP sheet.

The surface of the transfer member is preferably as smooth as possible in order to improve the smoothness of the image surface after fixing. For example, coating paper obtained by coating a surface of plain paper with a resin or the like, art paper for printing, and the like are preferably used.

The recording sheet P on which the fixing of the color image is completed is transported toward a discharge part, and a series of the color image forming operations ends.

The image forming apparatus exemplified as above has a configuration in which the toner image is transferred onto the recording sheet P via the intermediate transfer belt 20. However, the invention is not limited to this configuration, and may have a structure in which the toner image is transferred directly onto the recording sheet from the photoreceptor.

Process Cartridge and Toner Cartridge

Figure 2:
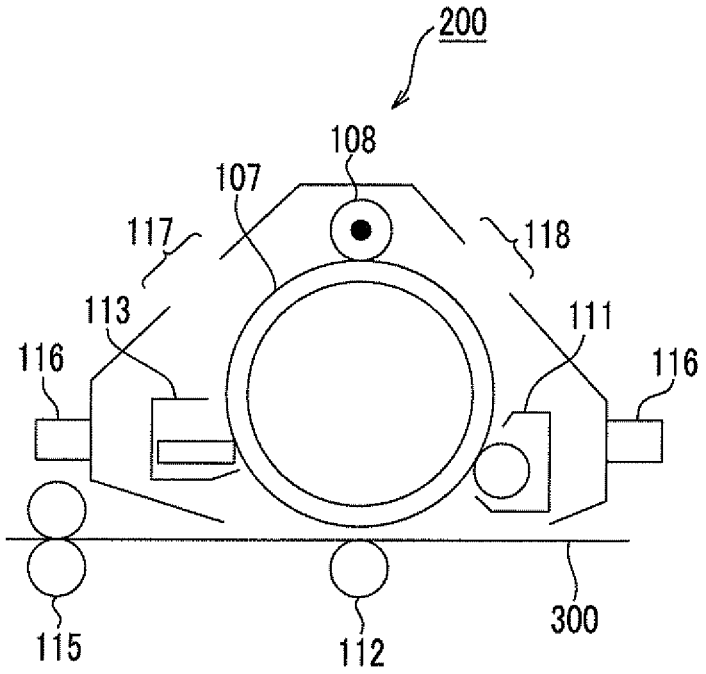
FIG. 2 is a schematic diagram showing a configuration of an example of a process cartridge according to the exemplary embodiment.

FIG. 2 is a schematic diagram showing a configuration of a preferable example of a process cartridge that accommodates the electrostatic charge image developer according to this exemplary embodiment. A process cartridge 200 has, in addition to a photoreceptor 107, a charging device 108, a developing device 111, a photoreceptor cleaning device 113, an opening 118 for exposure, and an opening 117 for erasing exposure, and they are combined and integrated using an attachment rail 116. The reference numeral 300 in FIG. 2 denotes a transfer member.

The process cartridge 200 is detachably mounted on an image forming apparatus configured by a transfer device 112, a fixing device 115, and other constituent parts (not shown).

The process cartridge 200 shown in FIG. 2 is provided with the charging device 108, the developing device 111, the cleaning device 113, the opening 118 for exposure, and the opening 117 for erasing exposure, but these devices may be selectively combined. The process cartridge of this exemplary embodiment is provided with, as well as the photoreceptor 107, at least one selected from the group consisting of the charging device 108, the developing device 111, the cleaning device (cleaning unit) 113, the opening 118 for exposure, and the opening 117 for erasing exposure.

Next, a toner cartridge according to this exemplary embodiment will be described. The toner cartridge according to this exemplary embodiment is a toner cartridge that is detachably mounted on an image forming apparatus and accommodates at least an electrostatic charge image developing toner for replenishment for supplying to the developing unit provided in the image forming apparatus.

The image forming apparatus shown in FIG. 1 is an image forming apparatus that has a configuration in which the toner cartridges 8Y, 8M, 8C, and 8K are detachably mounted. The developing devices 4Y, 4M, 4C, and 4K are connected to the toner cartridges corresponding to the respective developing devices (colors) via toner supply tubes (not shown). In addition, when the toner accommodated in the toner cartridge runs low, the toner cartridge is replaced.

EXAMPLES

Hereinafter, this exemplary embodiment will be described in detail using examples, but is not limited to the examples. In the following description, unless specifically noted, "parts" and "%" are based on the weight.

Synthesis of Polyester Resin

Preparation of Amorphous Polyester Resin A 10 molar parts of bisphenol-A ethylene oxide (BPA-EO), 90 molar parts of bisphenol-A propylene oxide (BPA-PO), 95 molar parts of terephthalic acid (TPA), 5 molar parts of n-dodecenyl succinate (DSA), and 0.1 molar part of dibutyltin oxide are put into a heat-dried two-necked flask. Nitrogen gas is supplied to the container to maintain the inside of the container under an inert atmosphere and the temperature is increased. Then, a co-condensation polymerization reaction is conducted for from 12 hours to 20 hours at from 150° C. to 230° C., and then the pressure is gradually reduced at from 210° C. to 250° C., thereby synthesizing an amorphous polyester resin A having a weight average molecular weight of 10,000 and a Tg of 62° C.

Preparation of Amorphous Polyester Resin B

An amorphous polyester resin B having a weight average molecular weight of 11,000 and a Tg of 64° C. is synthesized in the same manner as in the preparation of the amorphous polyester resin A, except for using 20 molar parts of bisphenol-A ethylene oxide, 80 molar parts of bisphenol-A propylene oxide, 60 molar parts of terephthalic acid, 20 molar parts of n-dodecenyl succinate, and 20 molar parts of fumaric acid (FA).

Preparation of Amorphous Polyester Resin C and Amorphous Polyester Resin Particle Dispersion C An amorphous polyester resin C having a weight average molecular weight of 40,000 and a Tg of 57.0° C. is synthesized in the same manner as in the preparation of the amorphous polyester resin A, except for using 20 molar parts of bisphenol-A ethylene oxide, 80 molar parts of bisphenol-A propylene oxide, 70 molar parts of terephthalic acid, 30 molar parts of n-dodecenyl succinate, and 1 molar part of trimellitic acid (TMA). 13000 parts by weight of the amorphous polyester resin C, 10000 parts by weight of ion exchange water, and 90 parts by weight of sodium dodecylbenzenesulfonate are put into an emulsification tank of a high-temperature and high-pressure emulsifier (Cavitron CD1010). Thereafter, these materials are melted by heating at 130° C., and then dispersed for 30 minutes at 10000 rpm, a flow rate of 3 L/m, and 110° C. and allowed to pass through a cooling tank. Whereby, an amorphous polyester resin particle dispersion C having a solid content of 30% and a volume average particle size D50v of 150 nm is prepared.

Preparation of Crystalline Polyester Resin A 45 molar parts of 1,9-nonanediol, 55 molar parts of dodecane dicarboxylic acid, and 0.05 molar part of dibutyltin oxide are put into a heat-dried three-necked flask. Thereafter, nitrogen gas is supplied to the container to maintain the inside of the container under an inert atmosphere and the temperature is increased. Then, a co-condensation polymerization reaction is conducted for 2 hours at from 150° C. to 230° C., and then the temperature is gradually increased to 230° C. and stirring is performed for 10 hours. When the resultant material becomes viscous, air-cooling is performed to stop the reaction, thereby synthesizing a crystalline polyester resin A having a molecular weight of 10,000 and a melting temperature of 75° C.

Preparation of Crystalline Polyester Resin B

A crystalline polyester resin B having a molecular weight of 12500 and a melting temperature of 71° C. is synthesized in the same manner as in the preparation of the crystalline polyester resin A, except for using 45 molar parts of 1,6-hexanediol and 55 molar parts of sebacic acid.

Preparation of Copolymer Particle Dispersion A 180 parts by weight of the amorphous polyester resin A and 180 parts by weight of the crystalline polyester resin A are put into a heat-dried reaction container. Thereafter, 0.1 molar parts of dibutyltin oxide is put thereinto, nitrogen gas is supplied to the container to maintain the inside of the container under an inert atmosphere, and the temperature is increased. Then, a co-condensation polymerization reaction is conducted for 5 hours at 215° C., and then the temperature is gradually increased to 230° C. and stirring is performed for hours. When the resultant material becomes viscous, air-cooling is performed to stop the reaction, thereby synthesizing a polyester block copolymer A having a molecular weight of 50000. 3000 parts by weight of the obtained polyester block copolymer A, 10000 parts by weight of ion exchange water, and 90 parts by weight of sodium dodecylbenzenesulfonate are put into an emulsification tank of a high-temperature and high-pressure emulsifier (Cavitron CD1010). Thereafter, these materials are melted by heating at 130° C., and then dispersed for 30 minutes at 10000 rpm, a flow rate of 3 L/m, and 110° C. and allowed to pass through a cooling tank. Whereby, a polyester block copolymer particle dispersion A having a solid content of 30%, a volume average particle size D50v of 190 nm, and a weight average molecular weight of 50,000 is prepared.

Preparation of Copolymer Particle Dispersion B

A polyester block copolymer B is synthesized and a polyester block copolymer particle dispersion B having a weight average molecular weight of 45,000 is obtained in the same manner as in the preparation of the copolymer particle dispersion A, except for the changes to 120 parts by weight of the crystalline polyester block particle dispersion A and to 240 parts by weight of the amorphous polyester block particle dispersion A in a heat-dried reaction container.

Preparation of Copolymer Particle Dispersion C

A polyester block copolymer C is synthesized and a polyester block copolymer particle dispersion C having a solid content of 30%, a volume average particle size D50v of 165 nm, and a weight average molecular weight of 48000 is obtained in the same manner as in the preparation of the copolymer particle dispersion A, except for the changes to 180 parts by weight of the crystalline polyester block particle dispersion B and to 180 parts by weight of the amorphous polyester block particle dispersion A in a heat-dried reaction container.

Preparation of Copolymer Particle Dispersion D

A polyester block copolymer D is synthesized and a polyester block copolymer particle dispersion D having a solid content of 30%, a volume average particle size D50v of 170 nm, and a weight average molecular weight of 52000 is obtained in the same manner as in the preparation of the copolymer particle dispersion A, except for the changes to 180 parts by weight of the crystalline polyester block particle dispersion A and to 180 parts by weight of the amorphous polyester block particle dispersion A in a heat-dried reaction container.

Preparation of Amorphous Polyester Resin Particle Dispersion S1

80 molar parts of bisphenol-A propylene oxide, 20 molar parts of bisphenol-A ethylene oxide, 40 molar parts of terephthalic acid, 90 molar parts of fumaric acid, 20 molar parts of n-dodecenyl succinate, and 0.1 molar part of dibutyltin oxide are put into a heat-dried reaction container. Nitrogen gas is supplied to the container to maintain the inside of the container under an inert atmosphere and the temperature is increased. Then, a co-condensation polymerization reaction is conducted for from 12 hours to 20 hours at from 150° C. to 230° C., and then the pressure is gradually reduced at from 210° C. to 250° C., thereby synthesizing an amorphous polyester resin S1 having an ethylenically unsaturated double bond, having a weight average molecular weight of 25,000 and a Tg of 60° C.

3000 parts by weight of the obtained amorphous polyester resin S1 having an ethylenically unsaturated double bond, 10000 parts by weight of ion exchange water, and 90 parts by weight of sodium dodecylbenzenesulfonate are put into an emulsification tank of a high-temperature and high-pressure emulsifier (Cavitron CD1010). Thereafter, these materials are melted by heating at 130° C., and then dispersed for 30 minutes at 10000 rpm, a flow rate of 3 L/m, and 110° C. and allowed to pass through a cooling tank. Whereby, an amorphous polyester resin particle dispersion S1 having a solid content of 30% and a volume average particle size D50v of 140 nm is prepared.

Preparation of Amorphous Polyester Resin Particle Dispersion S2

An amorphous polyester particle dispersion 52 having a solid content of 30% and a volume average particle size D50v of 180 nm is prepared in the same manner as in the case of the amorphous polyester resin particle dispersion S1, except for using 80 molar parts of bisphenol-A propylene oxide, 20 molar parts of bisphenol-A ethylene oxide, 60 molar parts of terephthalic acid, 40 molar parts of maleic acid (MA), and 20 molar parts of n-dodecenyl succinate. An amorphous polyester resin S2 of the amorphous polyester particle dispersion S2 has a weight average molecular weight of 26,000 and a Tg of 58° C.

Preparation of Amorphous Polyester Resin Particle Dispersion S3

An amorphous polyester particle dispersion S3 having a solid content of 30% and a volume average particle size D50v of 175 nm is prepared in the same manner as in the case of the amorphous polyester resin particle dispersion S1, except for using 60 molar parts of bisphenol-A propylene oxide, 40 molar parts of bisphenol-A ethylene oxide, and 100 molar parts of terephthalic acid in a heat-dried reaction container. An amorphous polyester resin S3 of the amorphous polyester particle dispersion S3 has a weight average molecular weight of 23,000 and a Tg of 64° C.

Preparation of Colorant Dispersion 45 parts by weight of carbon black (Regal 330 manufactured by Cabot Corporation), 5 parts by weight of an ionic surfactant Neogen R (Dai-ichi Kogyo Seiyaku Co., Ltd.), and 200 parts by weight of ion exchange water are mixed and dissolved, and dispersed for 10 minutes by a homogenizer (IKA-Werke GmbH & Co. KG, Ultra Turrax). Next, a dispersion treatment is performed using an ultimizer, thereby obtaining a colorant dispersion having a solid content of 20% and a medium particle size of 245 nm.

Preparation of Release Agent Dispersion 45 parts by weight of paraffin wax (prepared by Nippon Seiro Co., Ltd., HNP 0190), 5 parts by weight of an ionic surfactant Neogen R (prepared by Dai-ichi Kogyo Seiyaku Co., Ltd.), and 200 parts by weight of ion exchange water are heated to 120° C. and subjected to a dispersion treatment by a pressure discharge-type Gaulin homogenizer, thereby obtaining a release agent dispersion having a solid content of 20% and a medium particle size of 219 nm.

EXAMPLES

Preparation of Toner Particles

Example 1

Preparation of Toner Particles A 1170 parts by weight of a copolymer particle dispersion A, 125 parts by weight of a colorant dispersion, 250 parts by weight of a release agent dispersion, 2.5 parts by weight of aluminum sulfate (manufactured by Wako Pure Chemical Industries, Ltd.), 0.5 part by weight of sodium dodecylbenzenesulfonate, 50 parts by weight of a 0.3 M nitric acid aqueous solution, and 500 parts by weight of ion exchange water are put in a round stainless-steel flask and dispersed using a homogenizer (Ultra Turrax T-50 manufactured by IKA-Werke GmbH & Co. KG). Then, the resultant material is heated to 50° C. in an oil bath for heating while being stirred. The resultant material is held at 50° C. After confirmation of the formation of aggregated particles having a volume average particle size of approximately 5.5 μm, 250 parts by weight of an additional amorphous polyester resin particle dispersion S1 is added, and then the resultant material is held for 30 minutes. Next, 1 N aqueous sodium hydroxide solution is added thereto until the pH reaches 8.5. Thereafter, the resultant material is heated to 80° C. while being stirred, and is then held for 1 hour.

After formation of coalesced particles, a solution obtained by dissolving 25 parts by weight of potassium persulfate (KPS) in 200 parts by weight of ion exchange water is added thereto and a reaction is conducted for 3 hours at 80° C., thereby forming a crosslinked product on surfaces of the coalesced particles.

A dispersion in which the coalesced particles (toner particles) having a crosslinked product formed on the surface thereof are dispersed is filtered, and the particles remaining on the filter paper are stirred with 500 parts by weight of deionized water so as to be re-dispersed. The resultant material is further filtered so as to be washed, and then dried by a freeze dryer, thereby obtaining toner particles A.

Example 2

Preparation of Toner Particles B

Toner particles B are obtained in the same manner as in the preparation of the toner particles A, except that the polymerization initiator to be added is changed from 25 parts by weight of the potassium persulfate (KPS) to 25 parts by weight of ammonium peroxodisulfate (APS).

Example 3

Preparation of Toner Particles C

Toner particles C are obtained in the same manner as in the case of the toner particles A, except for the change from 1170 parts by weight of the copolymer particle dispersion A to 1170 parts by weight of a copolymer particle dispersion B.

Example 4

Preparation of Toner Particles D

Toner particles D are obtained in the same manner as in the case of the toner particles A, except for the change from 1170 parts by weight of the copolymer particle dispersion A to 1170 parts by weight of a copolymer particle dispersion C.

Example 5

Preparation of Toner Particles E

Toner particles E are obtained in the same manner as in the case of the toner particles A, except for the change from 1170 parts by weight of the copolymer particle dispersion A to 1170 parts by weight of a copolymer particle dispersion D.

Example 6

Preparation of Toner Particles F

Toner particles F are obtained in the same manner as in the preparation of the toner particles A, except for the change from 250 parts by weight of the additional amorphous polyester resin particle dispersion S1 to 250 parts by weight of an amorphous polyester resin particle dispersion S2.

Example 7

Preparation of Toner Particles G

Toner particles G are obtained in the same manner as in the preparation of the toner particles A, except that the polymerization initiator to be added is changed from 25 parts by weight of the potassium persulfate (KPS) to 37.5 parts by weight of potassium persulfate (KPS).

Example 8

Preparation of Toner Particles H

Toner particles H are obtained in the same manner as in the preparation of the toner particles A, except for the change from 250 parts by weight of the additional amorphous polyester resin particle dispersion S1 to 125 parts by weight of an amorphous polyester resin particle dispersion S1 and the extension of the reaction for 3 hours at 80° C. to a reaction for 5 hours at 80° C.

Example 9

Preparation of Toner Particles

Toner particles I are obtained in the same manner as in the preparation of the toner particles A, except for the change from 250 parts by weight of the additional amorphous polyester resin particle dispersion S1 to 580 parts by weight of an amorphous polyester resin particle dispersion S1 and the extension of the reaction for 3 hours at 80° C. to a reaction for 5 hours at 80° C.

Example 10

Preparation of Toner Particles J

Toner particles J are obtained in the same manner as in case of the toner particles A, except for the change from 1170 parts by weight of the copolymer particle dispersion A to 820 parts by weight of a copolymer particle dispersion A and an amorphous polyester resin particle dispersion C.

Example 11

Preparation of Toner Particles L

Toner particles L are obtained in the same manner as in the preparation of the toner particles A, except for the change from 250 parts by weight of the additional amorphous polyester resin particle dispersion S1 to 75 parts by weight of an amorphous polyester resin particle dispersion S1.

Example 12

Preparation of Toner Particles M

Toner particles M are obtained in the same manner as in the preparation of the toner particles A, except for the change from 250 parts by weight of the additional amorphous polyester resin particle dispersion S1 to 750 parts by weight of an amorphous polyester resin particle dispersion S1.

COMPARATIVE EXAMPLES

Preparation of Toner Particles

Comparative Example 1

Preparation of Toner Particles a 1420 parts by weight of a copolymer particle dispersion A, 125 parts by weight of a colorant dispersion, 250 parts by weight of a release agent dispersion, 2.5 parts by weight of aluminum sulfate (manufactured by Wako Pure Chemical Industries, Ltd.), 0.5 part by weight of sodium dodecylbenzenesulfonate, 50 parts by weight of a 0.3 M nitric acid aqueous solution, and 500 parts by weight of ion exchange water are accommodated in a round stainless-steel flask and dispersed using a homogenizer (Ultra Turrax T-50 manufactured by IKA-Werke GmbH & Co. KG). Then, the resultant material is heated to 50° C. in an oil bath for heating while being stirred. The resultant material is held at 50° C. After confirmation of the formation of aggregated particles having a volume average particle size of approximately 6.0 μm, 1 N aqueous sodium hydroxide solution is added thereto until the pH reaches 8.5. Thereafter, the resultant material is heated to 80° C. while being stirred, and is then held for 1 hour. Toner particles a are obtained in the same manner as in the preparation of the toner particles A, except for the above changes.

Comparative Example 2

Preparation of Toner Particles b

Comparative toner particles b are obtained in the same manner as in the preparation of the toner particles A, except that the polymerization initiator is not added after the formation of the coalesced particles.

Comparative Example 3

Preparation of Toner Particles c

Toner particles c are obtained in the same manner as in the preparation of the toner particles A, except for the change from 250 parts by weight of the additional amorphous polyester resin particle dispersion S1 to 250 parts by weight of an amorphous polyester resin particle dispersion 53.

Preparation of Toners

Preparation of Toners A to M and Comparative Toners a to c 1.5 parts by weight of hydrophobic silica (manufactured by Nippon Aerosil Co., Ltd., RY50) and 1.0 part by weight of hydrophobic titanium oxide (manufactured by Nippon Aerosil Co., Ltd., T805) are added to 50 parts by weight of the respective toner particles (A to J, L, M, and a to c) and blended with a sample mill to obtain toners (A to J and a to f).

Preparation of Developers 100 parts of ferrite particles (manufactured by Powdertech, average particle size: 50 μm) and 1.5 parts of a styrene/methyl methacrylate copolymer resin (weight average molecular weight: 80000) are put into a pressurizing kneader with 500 parts of toluene, and stirred and mixed for 15 minutes at room temperature. Then, while the resultant material is mixed under reduced pressure, the temperature is increased to 70° C. to distil away the toluene, and then cooling and classification using a 105-μm sieve are performed, thereby obtaining a resin-coated ferrite carrier.

The resin-coated ferrite carrier and each of the above-described external additive-added toners (A to J, L, M, and a to c) are mixed to prepare two-component electrostatic charge image developers (A to J and a to f) having a toner concentration of 8.5% by weight.

Examples 1 to 12 and Comparative Examples 1 to 3

The obtained toners and developers are defined as toners and developers of Examples 1 to 12 and Comparative Examples 1 to 3, and the following evaluations are performed. The results thereof are shown in Tables 1 and 2.

Evaluations

THF-Insoluble Matter of Toner

The THF-insoluble matter (crosslinked product) of the toner is calculated as described above using a MS part of an ion-trap GC/MS (POLARIS Q), manufactured by Thermo Fisher Scientific, as a measuring machine and a direct sample supply method.

Cp2 Peak Area Ratio

First, C—K shell NEXAFS spectra of a toner surface layer part and a center part are obtained by STXM. Next, regarding a peak at around 288.7 eV derived from the ethylenically unsaturated bond, a background is drawn at 288 eV and 290 eV to obtain a peak area, and this is defined as a C2p peak. By calculating C2p peaks of the toner surface layer part and the center part, ethylenically unsaturated bond existence ratios of the surface layer part and the center part are calculated.

As a result of comparison, when the C2p peak of the toner surface layer part is reduced as compared with that of the center part, it may be said that the surface layer part of the toner particles is configured to include a crosslinked product.

Heat-Resistant Blocking Property of Toner 10 g of each toner is weighed on a cup made of propylene and left for 17 hours under the environment of 50° C. and 50% RH to evaluate the state of blocking (aggregation) with the following standards.

The evaluation standards of the low-temperature fixability are as follows.

A: The toner smoothly flows when giving a tilt to the cup.

B: The toner is gradually broken and flows when moving the cup.

C: Blocks are generated, and the toner is broken when being thrusted with a sharp object.

D: Blocks are generated, and the toner is not easily broken even when being thrusted with a sharp object.

Low-Temperature Fixability (Minimum Fixing Temperature)

The low-temperature fixability (minimum fixing temperature) is evaluated as follows.

A developing machine of a modified DocuCentre Color 500 (modified for fixing by an external fixing machine at a variable fixing temperature) manufactured by Fuji Xerox Co., Ltd. is filled with the respective developers. Using this apparatus, a solid toner image is formed on color paper (J paper) manufactured by Fuji Xerox Co., Ltd. with a toner coverage adjusted to 13.5 g/m$^2$. After output of the toner image, the toner image is fixed using an external fixing machine at a fixing rate of 150 mm/sec with a nip width of 6.5 mm or less.

The fixing temperature is increased in increments of 5° C. from 130° C. to fix the toner image. The image fixed to the paper is folded so that the fold is positioned inside at substantially the center of the solid part, and a part in which the fixed image is broken is wiped with tissue paper to measure a width of the resultant white line and to perform the evaluation with the following evaluation standards.

A temperature at which the width of the white line is 0.4 mm or less is defined as a minimum fixing temperature. The minimum fixing temperature is preferably 150° C. or lower, and particularly preferably 145° C. or lower.

Toner Strength

The toner strength is evaluated as follows.

A developing machine of a modified DocuCentre Color f450 (modified for fixing by an external fixing machine at a variable fixing temperature) manufactured by Fuji Xerox Co., Ltd. is filled with the respective developers. Using this apparatus, toner crushing on the photoreceptor due to the cleaning blade after continuous printing of 3000 solid images having an area ratio of 50%, and toner filming (film-like streaks generated due to the toner crushing) to the photoreceptor due to the toner crushing are visually checked, and the residual toner on the photoreceptor and the blade part are confirmed through microscopic observation.

The evaluation standards are as follows.

A: No toner crushing and no filming are observed.

B: No filming. However, slight toner crushing is observed in the blade part at a level at which there are no problems in practical use.

C: Filming due to toner crushing is observed on the photoreceptor. There are problems in practical use.

Image Unevenness

Image unevenness is evaluated as follows.

A developing machine of a DocuCentre Color f450 (manufactured by Fuji Xerox Co., Ltd.) is filled with the respective developers. As for the paper, A4 paper (C2 paper, manufactured by Fuji Xerox Co., Ltd.) is used and test printing is performed through the output in an A4 transverse feed mode. As for the evaluation print image, a solid image of 1.2 cm×17.0 cm (width) (the side in the output direction is a long side) is output as a test chart at positions of 4 cm, 14 cm, and 23 cm, respectively, from the upper end of A4 paper in a longitudinal direction. The image density is measured using X-Rite 938 (manufactured by Nippon Heiban Kizai K.K.), and an average of the five measurement values in an objective region is defined as the image density. As for the adjustment of the image density, the image density is adjusted to be ID=from 1.25 to 1.55 based on the density measurement results of the print image every time when 1,000 sheets of paper are printed. As for the evaluation environment, the evaluation is started indoors under the environment of a temperature of 22° C. and a humidity of 55%, and the environment is shifted every 20,000 sheets of paper with a cycle of the environment of a temperature of 28° C. and a humidity of 80%, the environment of a temperature of 10° C. and a humidity of 20%, and the initial environment of a temperature of 22° C. and a humidity of 55% to conduct the evaluation.

After image formation on 120,000 pieces of paper, a full-scale half-tone image having an image density ID of from 0.6 to 0.8 is printed. An absolute value of a half-tone image density difference Δ between an image position and a non-image position of the test chart on the half-tone image is calculated and evaluated with the following standards.

The evaluation standards of the image unevenness are as follows.

A: less than 0.03

B: from 0.03 to less than 0.07

C: from 0.07 to less than 0.1

D: 0.1 or greater

TABLE 1

| | | | Examples | | | | | | | |
|---|---|---|---|---|---|---|---|---|---|---|
| | | | 1 | 2 | 3 | 4 | 5 | 6 | 7 | 8 |
| Toner No. | | | A | B | C | D | E | F | G | H |
| Core | Polyester | Sample No. | A | A | B | C | D | A | A | A |
| (binder | Block | Weight Average | 50000 | 50000 | 45000 | 48000 | 52000 | 50000 | 50000 | 50000 |
| resin) | Copolymer | Molecular Weight | | | | | | | | |

TABLE 1-continued

| | | | Examples | | | | | | | |
|---|---|---|---|---|---|---|---|---|---|---|
| | | | 1 | 2 | 3 | 4 | 5 | 6 | 7 | 8 |
| | | Weight Ratio in Binder Resin | 100 | 100 | 100 | 100 | 100 | 100 | 100 | 100 |
| | Amorphous Polyester | Sample No. | — | — | — | — | — | — | — | — |
| | | Weight Ratio in Binder Resin | 0 | 0 | 0 | 0 | 0 | 0 | 0 | 0 |
| | Crystalline Polyester | Sample No. | — | — | — | — | — | — | — | — |
| | | Weight Ratio in Binder Resin | 0 | 0 | 0 | 0 | 0 | 0 | 0 | 0 |
| Shell (shell layer) | Amorphous Polyester Resin | Sample No. | S1 | S1 | S1 | S1 | S1 | S2 | S1 | S1 |
| | | Polyvalent Carboxylic Acid | FA/TPA/DSA | FA/TPA/DSA | FA/TPA/DSA | FA/TPA/DSA | FA/TPA/DSA | MA/TPA/DSA | FA/TPA/DSA | FA/TPA/DSA |
| | | Polyol | BPA-EO/PO | BPA-EO/PO | BPA-EO/PO | BPA-EO/PO | BPA-EO/PO | BPA-EO/PO | BPA-EO/PO | BPA-EO/PO |
| | | Weight Average Molecular Weight | 25000 | 25000 | 25000 | 25000 | 25000 | 26000 | 25000 | 25000 |
| | | Tg (° C.) | 60 | 60 | 60 | 60 | 60 | 58 | 60 | 60 |
| | | Amount of Shell (wt %) | 15 | 15 | 15 | 15 | 15 | 15 | 15 | 15 |
| Cross-linking Treat-ment | Method | Treatment | Treated | Treated | Treated | Treated | Treated | Treated | Treated | Treated |
| | | Polymerization Initiator Type | KPS | APS | KPS | KPS | KPS | KPS | KPS | KPS |
| | | Amount of Polymerization Initiator to be Added (parts by weight with respect to toner) | 5 | 5 | 5 | 5 | 5 | 5 | 7.5 | 8.5 |
| | | Crosslinking Treatment Time (H) | 3.0 | 3.0 | 3.0 | 3.0 | 3.0 | 3.0 | 3.0 | 6.0 |
| Physical Properties of Toner | | Particle Size (μm) | 6.0 | 5.8 | 5.8 | 6.0 | 6.1 | 6.2 | 5.9 | 6.1 |
| | | THF-Insoluble Matter (wt %) | 2.5 | 1.5 | 1.7 | 2.1 | 3.1 | 1.1 | 4.8 | 5.3 |
| Evaluation of Toner Characteristics | | Blocking Property | B | C | B | C | B | B | B | B |
| | | Minimum Fixing Temperature (° C.) | 132 | 125 | 145 | 124 | 140 | 128 | 143 | 150 |
| | | Toner Strength | A | A | A | B | A | A | A | A |
| | | Image Unevenness | B | B | B | B | B | B | B | B |

TABLE 2

| | | | Examples | | | | Comparative Examples | | |
|---|---|---|---|---|---|---|---|---|---|
| | | | 9 | 10 | 11 | 12 | 1 | 2 | 3 |
| Toner No. | | | I | J | L | M | a | b | c |
| Core (binder resin) | Polyester Block Copolymer | Sample No. | A | A | A | A | A | A | A |
| | | Weight Average Molecular Weight | 50000 | 50000 | 50000 | 50000 | 50000 | 50000 | 50000 |
| | | Weight Ratio in Binder Resin | 100 | 70 | 100 | 100 | 100 | 100 | 100 |
| | Amorphous Polyester | Sample No. | — | C | — | — | — | — | — |
| | | Weight Ratio in Binder Resin | 0 | 30 | 0 | 0 | 0 | 0 | 0 |
| | Crystalline Polyester | Sample No. | — | — | — | — | — | — | — |
| | | Weight Ratio in Binder Resin | 0 | 0 | 0 | 0 | 0 | 0 | 0 |
| Shell (shell layer) | Amorphous Polyester Resin | Sample No. | S1 | S1 | S1 | S1 | — | S1 | S3 |
| | | Polyvalent Carboxylic Acid | FA/TPA/DSA | FA/TPA/DSA | FA/TPA/DSA | FA/TPA/DSA | — | FA/TPA/DSA | TPA |
| | | Polyol | BPA-EO/PO | BPA-EO/PO | BPA-EO/PO | BPA-EO/PO | — | BPA-EO/PO | BPA-EO/PO |
| | | Weight Average Molecular Weight | 25000 | 25000 | 25000 | 25000 | — | 25000 | 23000 |
| | | Tg (° C.) | 60 | 60 | 60 | 60 | — | 60 | 64 |
| | | Amount of Shell (wt %) | 35 | 15 | 4.5 | 40 | — | 15 | 15 |
| Cross-linking Treat-ment | Method | Treatment | Treated | Treated | Treated | Treated | Treated | None | Treated |
| | | Polymerization Initiator Type | KPS | KPS | KPS | KPS | KPS | — | KPS |
| | | Amount of Polymerization Initiator to be Added (parts by weight with respect to toner) | 5 | 5 | 5 | 5 | 5 | — | 5 |
| | | Crosslinking Treatment Time (H) | 3 | 3 | 3 | 3 | 3 | — | 3 |
| Physical Properties of Toner | | Particle Size (μm) | 6.1 | 5.8 | 5.5 | 5.9 | 5.8 | 5.9 | 6.2 |
| | | THF-Insoluble Matter (wt %) | 4.8 | 0.5 | 0.1 | 7.0 | 0 | 0 | 0 |

TABLE 2-continued

| | | Examples | | | | Comparative Examples | | |
|---|---|---|---|---|---|---|---|---|
| | | 9 | 10 | 11 | 12 | 1 | 2 | 3 |
| Evaluation of Toner Characteristics | Blocking Property | B | B | C | B | B | B | B |
| | Minimum Fixing Temperature (° C.) | 145 | 146 | 122 | 160 | 120 | 121 | 134 |
| | Toner Strength | A | A | C | A | C | C | C |
| | Image Unevenness | B | B | B | B | D | D | D |

From the above-described results, it is found that in the examples, favorable results are obtained in low-temperature fixability and image unevenness, as compared with the comparative examples.

In addition, it is found that in the examples, favorable results are obtained in the evaluations for a heat-resistant blocking property and toner transferability, together with the low-temperature fixability and the image unevenness, as compared with the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles having:

a core that includes a block copolymer of a crystalline polyester block and an amorphous polyester block, and a shell that covers the core and includes:

an interior layer including an amorphous polyester resin having an ethylenically unsaturated double bond, the amorphous polyester resin being non-crosslinked, and a surface layer including a crosslinked product of the amorphous polyester resin having an ethylenically unsaturated double bond.

2. The electrostatic charge image developing toner according to claim 1, wherein in the toner particles, a resin-insoluble component that is insoluble in tetrahydrofuran is 5.0% by weight or less with respect to the toner particles.

3. The electrostatic charge image developing toner according to claim 1, wherein the shell is from 5.0% by weight to 40% by weight with respect to the toner particles.

4. The electrostatic charge image developing toner according to claim 1, wherein the block copolymer is included in an amount of from 5.0% by weight to 100% by weight in a binder resin of the core.

5. The electrostatic charge image developing toner according to claim 1, wherein the weight ratio of the crystalline polyester block to the amorphous polyester block in the block copolymer is from 1/20 to 20/1 (crystalline polyester block/amorphous polyester block).

6. The electrostatic charge image developing toner according to claim 1, wherein the weight ratio of the crystalline polyester block to the amorphous polyester block in the block copolymer is from 1/10 to 10/1 (crystalline polyester block/amorphous polyester block).

7. The electrostatic charge image developing toner according to claim 1, wherein a weight average molecular weight (Mw) of the block copolymer is from 15000 to 70000.

8. The electrostatic charge image developing toner according to claim 1, wherein the crystalline polyester block is selected from a condensation polymer of ethylene glycol and glutaric acid, a condensation polymer of 1,9-nonanediol and 1,10-decanedicarboxylic acid, a condensation polymer of cyclohexanediol and adipic acid, a condensation polymer of ethylene glycol, propanediol, or 1,6-hexanediol and sebacic acid, and a condensation polymer of ethylene glycol, propanediol, or butanediol and succinic acid.

9. The electrostatic charge image developing toner according to claim 1, wherein the amorphous polyester block is selected from a condensation product of terephthalic acid and an ethylene oxide adduct of bisphenol-A, a condensation product of terephthalic acid and a propylene oxide-and-ethylene oxide adduct of bisphenol A, and a condensation product of n-dodecylsuccinic acid, terephthalic acid, and a propylene oxide adduct of bisphenol-A.

10. The electrostatic charge image developing toner according to claim 1, wherein the amorphous polyester resin having an ethylenically unsaturated double bond is a condensation polymer of at least one of dicarboxylic acid selected from fumaric acid, maleic acid, and maleic anhydride and a diol.

11. An electrostatic charge image developer comprising:

the electrostatic charge image developing toner according to claim 1.

12. A toner cartridge that has a toner accommodating chamber, wherein the toner accommodating chamber contains the electrostatic charge image developing toner according to claim 1.

13. A process cartridge, comprising:

an accommodating chamber that contains the electrostatic charge image developer according to claim 11; and a developing unit that develops an electrostatic charge image with the electrostatic charge image developer.

14. An image forming apparatus comprising:

an image holding member;

a charging unit that charges the image holding member;

an electrostatic charge image forming unit that forms an electrostatic charge image on a surface of the image holding member;

a developing unit that develops the electrostatic charge image with a developer including a toner to form a toner image;

a transfer unit that transfers the toner image onto a surface of a transfer member from the image holding member; and a fixing unit that fixes the toner image transferred onto the surface of the transfer member, wherein the toner is the electrostatic charge image developing toner according to claim 1.

15. An image forming method comprising:

charging an image holding member;

forming an electrostatic charge image on a surface of the image holding member;

developing the electrostatic charge image formed on the surface of the image holding member with a developer including a toner to form a toner image;

transferring the toner image onto a surface of a transfer member; and fixing the toner image transferred onto the surface of the transfer member, wherein the toner is the electrostatic charge image developing toner according to claim 1.

* * * * *